United States Patent [19]

Seaman

[11] 3,973,364

[45] Aug. 10, 1976

[54] REINFORCED SEALED JOINT FOR MEMBRANE SEGMENTS

[75] Inventor: Norman R. Seaman, Sarasota, Fla.

[73] Assignee: Seaman Corporation, Sarasota, Fla.

[22] Filed: Oct. 28, 1975

[21] Appl. No.: 625,842

[52] U.S. Cl. ..... 52/57; 52/63; 52/80; 52/83; 52/222; 52/461; 135/1 R; 135/15 CF

[51] Int. Cl.[2] ..... E04B 7/14; E04B 1/347; A45F 1/16

[58] Field of Search ..... 52/80, 83, 63, 222, 52/461, 467–469, 57; 135/1, 3, 15 CF

[56] References Cited

UNITED STATES PATENTS

| | | | |
|---|---|---|---|
| 2,827,138 | 3/1958 | Roy | 52/63 |
| 3,240,217 | 3/1966 | Bird et al. | 52/2 |
| 3,465,764 | 9/1969 | Huddle | 135/3 |
| 3,531,899 | 10/1970 | Bartlett | 52/469 |
| 3,564,784 | 2/1971 | Mollinger | 52/63 |
| 3,849,956 | 11/1974 | Collins | 52/469 |

*Primary Examiner*—James L. Ridgill, Jr.
*Attorney, Agent, or Firm*—Hamilton, Renner & Kenner

[57] ABSTRACT

A sealed joint construction for connecting membrane segments covering a domed framework of rigid trusses. The side edges of adjoining segments are connected to brackets overlying the outer chord of the truss and the segments are tensioned by cables extending between the truss members and along the bottom edges of the segments. The joint is weather sealed by an overlying coextensive membrane strip having tensioning cables in its edges anchored to the foundation and resisting uplift loads on the membrane segments.

10 Claims, 5 Drawing Figures

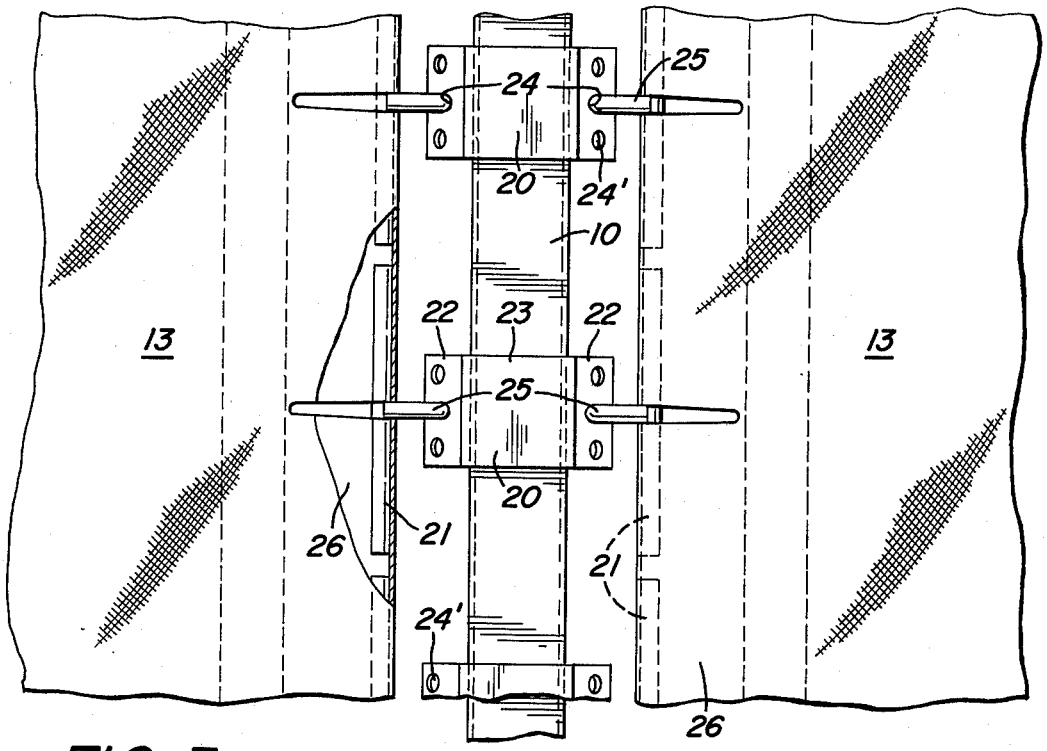
FIG. 3
FIG. 4
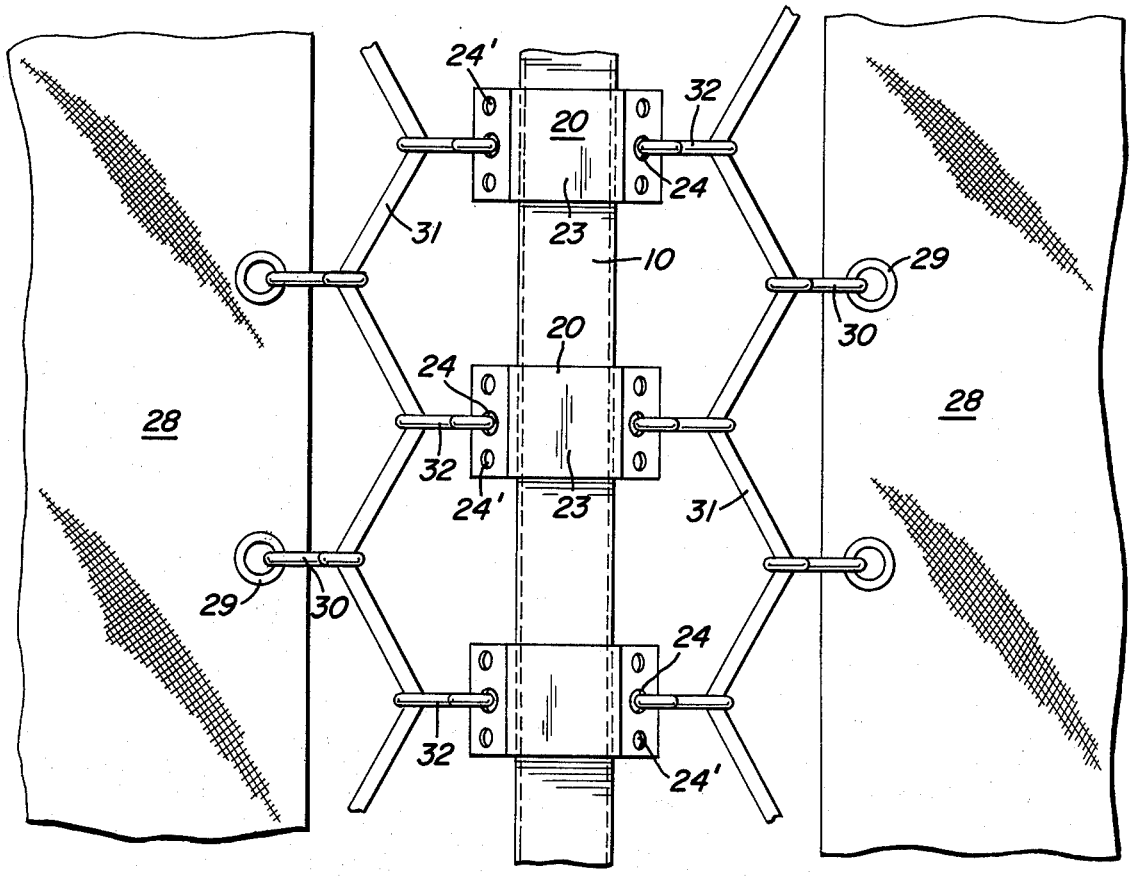

REINFORCED SEALED JOINT FOR MEMBRANE SEGMENTS

BACKGROUND OF THE INVENTION

The invention relates to a rigid frame structure having a tensioned fabric membrane covering such as disclosed in U.S. Pat. No. 3,872,634, issued March 25, 1975. The unitary membrane covering disclosed in said patent has numerous disadvantages in fabrication, transportation and installation due to its bulk and weight.

Extensive floor space is required to lay out and join the membrane sections into the required unitary configuration. Packaging and shipping is difficult and expensive, and erection of such a large unitary membrane is a laborious and difficult operation requiring special equipment and accessibility to the building site.

A defect or damage in the membrane requires a major repair job, and often replacement of the entire unitary covering resulting in exposure of the building contents and excessive expense.

Another difficulty with the unitary membrane covering is that extreme uplift loads tend to stretch the fabric sufficiently to bridge over an intermediate truss between two bays resulting in unduly high and damaging loads on the fabric membrane.

SUMMARY OF THE INVENTION

The present invention provides segments of fabric membrane covering the bays between trusses with field connection means connecting the edges of adjoining segments to a truss and anchored cables in the lower edges for tensioning the segments. Weatherseal strips extend along and overlie the joints between the segments and the trusses, and tensioning cables in the side edges of the strips hold the strips down on the segments and restrain the segments against uplift loads tending to stretch the membrane thereof.

It is an object of the present invention to provide a novel and improved reinforced weather-sealed joint structure for adjoining membrane segments held under tension over a rigid framework.

Another object is to provide an improved joint structure having improved means for connecting adjoining membrane covering segments to a supporting truss in the field.

A further object is to provide a novel weatherseal strip overlying and coextensive with the joint structure which strip is anchored under tension to the foundation for the framework.

Another object is to provide a novel weatherseal strip overlying and coextensive with the joint structure which has tensioning cables in its lateral edges reinforcing the underlying segments against uplift loads.

Still another object is to provide an improved joint structure in which the means for connecting the membrane segments to a supporting truss is adapted also to connect to underlying insulating membrane segments and to side curtains enclosing the openings formed at the bottoms of the segments.

A still further object is to provide an improved sealed joint system for connecting membrane segments on a rigid framework made up of a series of bays, whereby the building may be extended or shortened longitudinally by adding or subtracting bays and corresponding segments.

These and other objects are accomplished by the novel features and improvements comprising the present invention, a preferred embodiment of which is shown by way of example in the accompanying drawings and described in detail in the following specification. Various modifications and changes in details of construction are comprehended within the scope of the appended claims.

BRIEF DESCRIPTION OF THE DRAWINGS

FIG. 3 is an enlarged elevational view taken within the FIG. 3 circle indicated on FIG. 1, with the weatherseal strip removed.

FIG. 4 is an enlarged elevational view taken within the FIG. 4 circle indicated on FIG. 1, showing the manner of connecting adjoining side curtains to the intervening truss member and with the membrane segments and weatherseal strip removed.

DESCRIPTION OF A PREFERRED EMBODIMENT

The domed rigid framework of the present structure may be substantially the same as that shown in my prior U.S. Pat. No. 3,827,634, having a plurality of truss members forming side and end bays of a substantially polygonal enclosure. Each truss member has a curvilinear outer chord 10 which supports the membrane cover, and the outer chord has inclined reinforcing struts 11 which connect the outer chord to inner chord components (not shown herein) extending along the length of the truss member. The truss members preferably are connected at their upper ends to polygonal head members 12, and stringer trusses (not shown herein) preferably connect the head members along the ridge.

In the structure of said prior patent the tensioned fabric membrane covering the framework is a prefabricated unitary overall covering, whereas in the present structure separate segments of the fabric membrane are provided, one for each bay, and the segments are joined together under tension at each truss member in the field and a weatherseal reinforcing strip is stretched over the joint.

Figure 1:
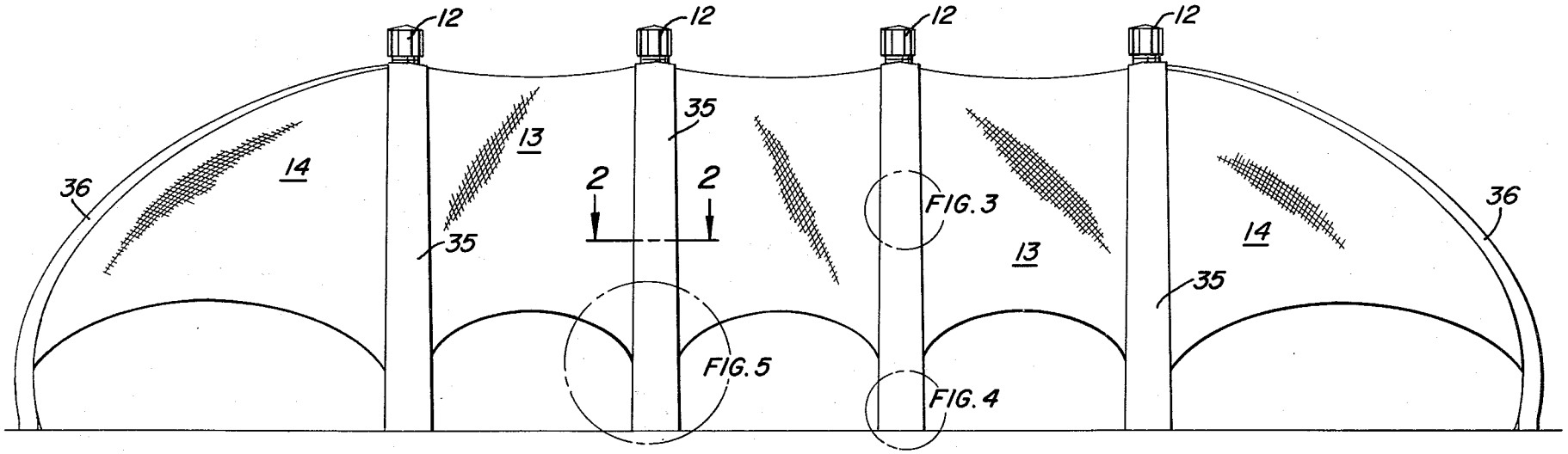
FIG. 1 is a side elevation of a rigid frame, tensioned fabric structure having the improved weather-sealed joint structure of the present invention.
Figure 2:
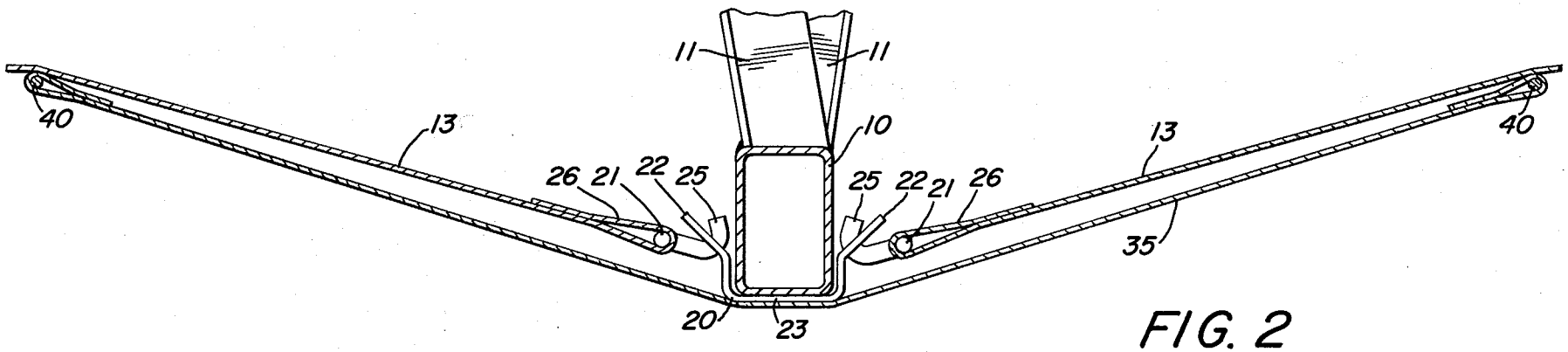
FIG. 2 is an enlarged partial sectional view at line 2 — 2 of FIG. 1.
Figure 5:
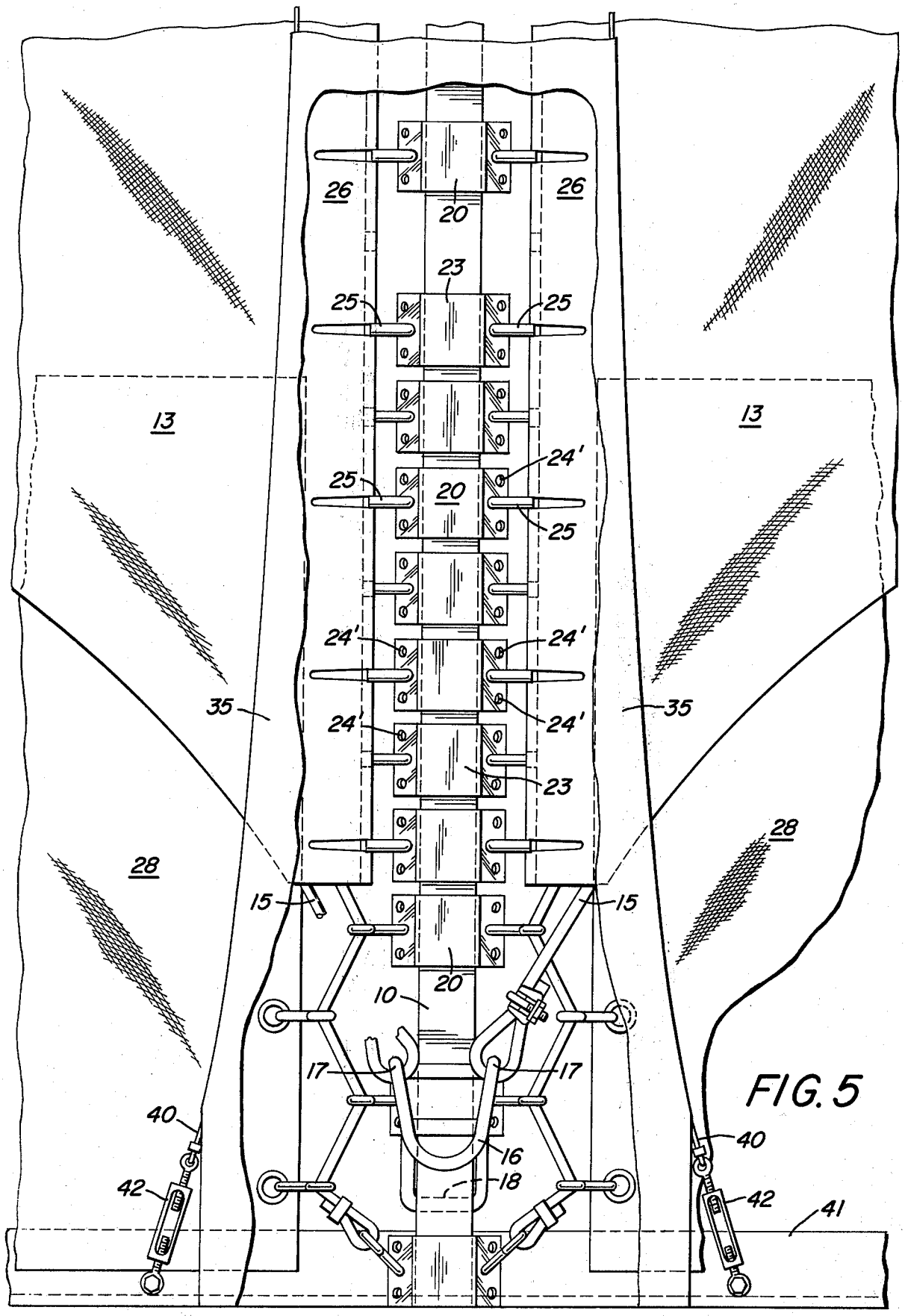
FIG. 5 is an enlarged elevational view taken within the FIG. 5 circle indicated on FIG. 1.

The membrane side segments are indicated at 13 and the end segments at 14. Each of the segments has static tension applied thereto by a catenary cable 15 in its bottom hem and the cables of adjoining segments may be connected to a tensioning assembly at the base of the outer chord of each truss member, said tensioning assembly being substantially the same as that shown in my prior patent. As seen in FIG. 5, the tensioning assembly includes a continuous double loop rod 16 having ear loops 17 to which the cables 15 are secured and having a transverse anchor bar 18 for adjustable attachment to the inner surface of the outer truss chord 10. Substantially uniform tension is applied to all of the membrane segments and the contour of each segment is a saddle shape so as to withstand both positive loading and negative loading due to windlift. The particular saddle shape and its advantages are fully described in said prior U.S. Pat. No. 3,872,624. It should be noted, however, that the fabric membrane and the supporting framework must be designed to resist windlift loads which are often twice as great as positive loads.

Referring now to the novel and improved joint structure of the present invention, the joints at each truss member are all identical so that only one is shown and described herein. The means for connecting adjoining membrane segments 13 and 14 together at each truss member preferably includes a series of bracket yokes 20 straddling the chord 10 and connected by anchor bars 21 to the hems of adjoining membrane segments. As shown, the bracket yokes each have two angular flanges 22 connected by a web 23 which fits over the outer portion of truss chord 10, and the flanges 21 have holes 24 therein for engaging with hooks 25 projecting from the central portions of the anchor bars 21 which are enclosed within the hems 26 of the adjoining segments.

In the field, the segments 13 are positioned in adjoining bays and the hooks 25 are pulled toward and hooked into the bracket yokes progressively along the intervening truss chord 10, using a suitable hand tool which will tension the segments laterally to a certain extent. After all the hooks have been engaged, tension is applied downwardly to the catenary cables 15 by means of the tensioning assembly connected thereto, as previously described, to form the segments into the desired saddle shape and preload them with the desired amount of uniform tension.

As indicated in FIGS. 4 and 5, side curtain panels 28 of fabric membrane may be provided to enclose the bottom openings formed below the curve hems of the membrane segments. The side curtains 28 may be rectangular in shape so as to underlap and be attached to the curved hems of the segments 13, and have their inner adjoining edges connected together at the intervening truss chord 10. As shown, the inner edges of the side curtain panels 28 have grommets 29 engaged by S-hooks 30, the other ends of which engage elastic cords 31. Between the S-hooks 30 the cords 31 are connected to bracket yokes 20 by S-hooks 32 engaged in the holes 24 thereof.

Weatherseal strips 35 of flexible fabric membrane are provided to overlie the joints between the membrane segments and the side curtains. These strips are longitudinally coextensive with the joints, and extend continuously from the bottom of one side truss over the top of the structure to the bottom of the opposite side truss. In the case of the end trusses the strips 36 extend from the bottom of the truss member to the head member 12, and are attached to the head member.

The side hems of the strips 35 and 36 enclose tensioning cables 40 which are anchored at the bottom ends to the foundation 41 of the structure by turn buckles 42. As shown the side hems of the strips substantially overlap the inner hems of the membrane segments 13 and the side curtains 28 so as to provide a weatherseal for the joints therebetween. The tensioned cables thus ensure a weathertight seal between the edges of the strips and the underlying membrane segments. In addition, the tensioned cables 40 hold down the membrane segments to assist in restraining windlift loads thereon. Since part of such loads is taken by the cables 40, a substantial reduction in the windlift loads transmitted to the framework is made possible.

The bracket yokes 20 are preferably provided with additional holes 24' for attaching the side curtains 28 in locations where the center holes 24 are already occupied by hooks 25, and also for attaching secondary inner membrane segments underlying the segments 13 for insulating purposes. Such secondary membrane segments would be designed so as to provide an air space between the outer segments and the secondary segments.

The use of membrane segments rather than a unitary membrane covering provides for lengthening or shortening a building in bay sections, and for economy in manufacturing, shipping and handling, as well as in erection in the field. Moreover, in the case of a localized defect or damage any panel can be quickly and easily replaced. The weatherseal strips are quickly and easily applied in the field to seal the joints and reinforce the membrane segments against windlift loads. The same brackets are used for connecting the adjoining edges of outer membrane segments, inner insulating segments and side curtain panels.

I claim:

1. In a sealed joint structure connecting adjoining segments of flexible membrane, an upright truss member forming part of a dome framework and having an outer chord, means detachably connecting the adjoining edges of two segments to said truss outer chord, a weatherseal strip of flexible membrane overlying and coextensive with said truss outer chord and overlapping the adjoining edges of said segments, and tensioning outer cables secured to the outer edges of said strip and anchored to the base of said framework to bear on and hold down the membrane segments against uplift loads.

2. In a sealed joint structure as described in claim 1, wherein the means detachably connecting the adjoining edges of two segments to said truss outer chord comprises brackets detachably supported on said chord and having flanges detachably connected to the adjoining edges of said two segments.

3. In a sealed joint structure as described in claim 2, wherein the adjoining edges of said two segments are provided with hooks engaging in apertures in said flanges.

4. In a sealed joint structure as described in claim 3, wherein said flanges are adapted to connect to the adjoining edges of curtain panels attached to the bottom edges of said membrane segments.

5. In a sealed joint structure as described in claim 2, wherein said brackets are yokes straddling said outer chord.

6. In a sealed joint structure as described in claim 3, wherein the adjoining edges of said two segments are provided with hooks engaging in apertures in said flanges.

7. In a sealed joint structure as described in claim 3, wherein said flanges are adapted to connect to the adjoining edges of curtain panels attached to the bottom edges of said membrane segments.

8. In a sealed joint structure as described in claim 2, wherein said flanges are adapted to connect to the adjoining edges of curtain panels attached to the bottom edges of said membrane segments.

9. In a sealed joint structure as described in claim 8, wherein said flanges are adapted to connect to the adjoining edges of insulation segments underlying said flexible membrane segments.

10. In a sealed joint structure as described in claim 9, wherein said brackets are yokes straddling said chord.

* * * * *

UNITED STATES PATENT OFFICE
CERTIFICATE OF CORRECTION

Patent No. 3,973,364 Dated August 10, 1976

Inventor(s) Norman R. Seaman

It is certified that error appears in the above-identified patent and that said Letters Patent are hereby corrected as shown below:

Column 2, line 30, "3,827,634" should read --- 3,872,634 ---.
Column 4, line 49, (Claim 6) and Column 4, line 53 (Claim 7), in each instance "3" should read --- 5 ---.

Signed and Sealed this
First Day of February 1977

[SEAL]

*Attest:*

RUTH C. MASON
*Attesting Officer*

C. MARSHALL DANN
*Commissioner of Patents and Trademarks*